United States Patent [19]

Hutzenlaub et al.

[11] Patent Number: 5,060,878

[45] Date of Patent: Oct. 29, 1991

[54] UNROLLING DEVICE

[75] Inventors: Armin Hutzenlaub; Klaus Albrecht, both of Wiehl, Fed. Rep. of Germany

[73] Assignee: Kampf GmbH & Co. Maschinenfabrik, Muhlen, Fed. Rep. of Germany

[21] Appl. No.: 477,561

[22] Filed: Feb. 9, 1990

[30] Foreign Application Priority Data

Mar. 1, 1989 [DE] Fed. Rep. of Germany ..... 3906515

[51] Int. Cl.[5] ..... B65H 16/06

[52] U.S. Cl. ..... 242/68.4; 242/54 R; 242/58.6; 242/57.1; 242/129.51

[58] Field of Search ..... 242/68.4, 54 R, 58.6, 242/79, 129.51, 57.1

[56] References Cited

U.S. PATENT DOCUMENTS

| | | | |
|---|---|---|---|
| 2,499,562 | 3/1950 | Behrens | 242/58.6 |
| 2,578,064 | 12/1951 | Hammond | 242/56 R |
| 3,331,318 | 7/1967 | Augustyn et al. | 242/68.4 X |
| 3,343,760 | 9/1967 | Haskin et al. | 242/68.6 |
| 3,743,198 | 7/1973 | Lucas | 242/58.6 |
| 4,209,190 | 6/1980 | Seibert | 242/58.6 X |
| 4,460,135 | 7/1984 | Hirakawa et al. | 242/68.4 |
| 4,718,817 | 1/1988 | Maillefer | 242/54 R X |
| 4,770,360 | 9/1988 | Liebelt | 242/68.4 X |
| 4,927,091 | 5/1990 | Weis et al. | 242/58.6 X |

FOREIGN PATENT DOCUMENTS

| | | | |
|---|---|---|---|
| 1574312 | 7/1971 | Fed. Rep. of Germany . | |
| 2256632 | 2/1974 | Fed. Rep. of Germany . | |
| 2214532 | 9/1989 | United Kingdom | 242/85 |

*Primary Examiner*—Daniel P. Stodola
*Assistant Examiner*—John P. Darling
*Attorney, Agent, or Firm*—Herbert Dubno; Andrew Wilford

[57] ABSTRACT

An unwinding device for a machine for the processing of strip material has a pair of arms which receive the roll between them and are movable toward and away from one another by a spindle having threaded portions of opposite hand engaging the respective arms. A bearing sleeve axially entraining the spindle is engaged between the fork shanks which are connected to a piston rod of a double acting cylinder mounted on the traverse along which the arms are guided to adjust the arms in axial direction transverse to the web feed direction.

3 Claims, 2 Drawing Sheets

UNROLLING DEVICE

FIELD OF THE INVENTION

Our present invention relates to an unrolling device for strip materials, i.e. webs, tapes, bands, strips of paper, metal foil, plastic or other flexible material. More particularly, the invention relates to an unrolling or unwinding device for use in a machine for the processing of strip materials, e.g. for the slitting thereof in the formation of magnetic tape, or for other processing operations including rerolling and the like.

BACKGROUND OF THE INVENTION

An unwinding or unrolling device can comprise a traverse or bar-like support extending transversely of the direction of feed of the web or strip material parallel to the axis of the roll or reel to be unwound and a pair of arms mounted on the guide formed by the traverse and displaceable toward and away from one another, for example to engage or disengage the roll to be unwound. Reference may be had in this regard to German patent document 2,256,632.

In general it may be said that such a device can include a traverse which is swingably mounted in a machine frame and defining a linear guide for the shiftable support arms or levers which engage the roll between them.

The spindle is driven by a spindle motor and can have threads of opposite hand (rotation sense) engaging nut formations of the arms or levers so that rotation of the spindle in one direction by the motor will draw the arms toward one another whereas rotation of the spindle in the opposite sense will cause the arms to move apart.

An unwinding device of this type must be adjustable in the axial direction of the roll to allow a new roll to be spliced in an edge-true manner to the trailing end of the web delivered by a previous roll or to control the position of the web so that it will run with precise positioning of the edges thereof during the unrolling operation.

The unwinding carriages heretofore used for this purpose were suitable for handling of heavy rolls or reels of strip material but were expensive, difficult to maintain and not always useful in machines for processing of the web.

OBJECTS OF THE INVENTION

It is the principal object of the present invention to provide an improved unwinding device for the purposes described which is more versatile, reliable and accurate than unwinding devices utilized heretofore.

Another object of this invention is to provide an improved unwinding device which can be integrated into a web or strip processing machine wile retaining the transverse shiftability of the roll, coil or reel.

Still another object of this invention is to provide a relatively simple and highly versatile unwinding device which is capable of use in a wider variety of web processing machines than has been the case heretofore.

SUMMARY OF THE INVENTION

These objects and others which will become apparent hereinafter are attained, in accordance with the invention, by providing an adjusting or positioning cylinder on the traverse and connecting the piston rod of this cylinder, which extends in the axial direction of the traverse, with a bearing sleeve or journal block in which a spindle is journaled in a pair of supporting arms, thereby displacing the arms on respective guides jointly with the aid of this spindle.

The invention thus differs from the state of the art in that the spindle is utilized both for the displacement of the individual arms in the same and in opposite directions, the latter to enable the roll to be received between them and the former for adjustment of the axial position of the roll. Consequently, the spindle has an additional function in the system of the invention.

This is made possible, in accordance with the invention in that the spindle is not only rotatably journaled but is shiftable in the axial direction. This construction has been found to be especially advantageous for light rolls or coils which can be handled directly on the machine frame.

A reliable coupling of the spindle motor with the spindle can be achieved in accordance with the invention by mounting the spindle motor on the bearing sleeve or journal block.

Stable guiding of the spindle and uniform adjustment sensitivity in both directions of adjustment can be achieved by providing the positioning cylinder as a double-acting cylinder and having the piston extend from both opposite axial ends of the cylinder to engage the bearing sleeve by the shanks of a fork which straddle axially the bearing sleeve.

Reliable entrainment of the spindle is ensured by journaling the spindle within the bearing sleeve by a two-sided axial thrust bearing.

More specifically, the unwinding device of the invention comprises:

- a support;
- a traverse swingably mounted on the support for pivotal movement about an axis;
- a pair of roll-support arms slidable on the traverse toward and away from one another and slidable jointly along the traverse in a direction parallel to the axis, the roll-support arms being provided with means engaging a roll of a strip material to be unwound;
- a spindle having threaded portions of opposite hand threadedly connected to the respective arms and rotatable to draw the arms toward one another and to displace the arms apart;
- a journal sleeve receiving the spindle and enabling rotation thereof;
- a spindle motor operatively connected to the spindle for rotating same in the sleeve; and
- a positioning cylinder mounted on the traverse and having a piston rod extending generally in the direction and operatively connected to the sleeve for displacing the arms jointly parallel to the axis.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
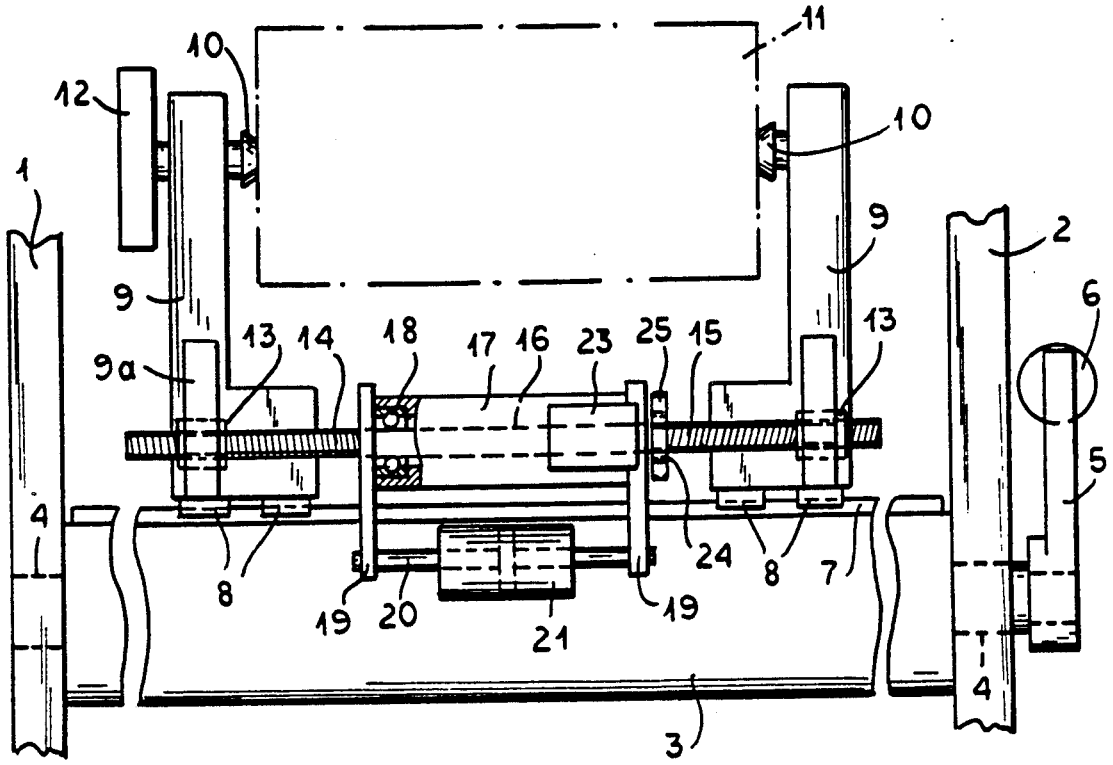
FIG. 1 is a diagrammatic elevational view of the unwinding device of the invention.

From FIG. 1 it will be apparent that the machine frame can comprise two side plates or cheek plates 1 and 2 of a machine for processing strip materials, e.g. webs of a flexible material The processing machine may be a cutting machine for slitting the strip material into tapes, a rewinding machine or the like. The invention is concerned primarily with the unwinding of a reel, roll 11 or coil for such types of processing machines.

Between the frame plates 1 and 2, a traverse 3 is pivotable on trunnions or stub shafts 4.

Figure 3:
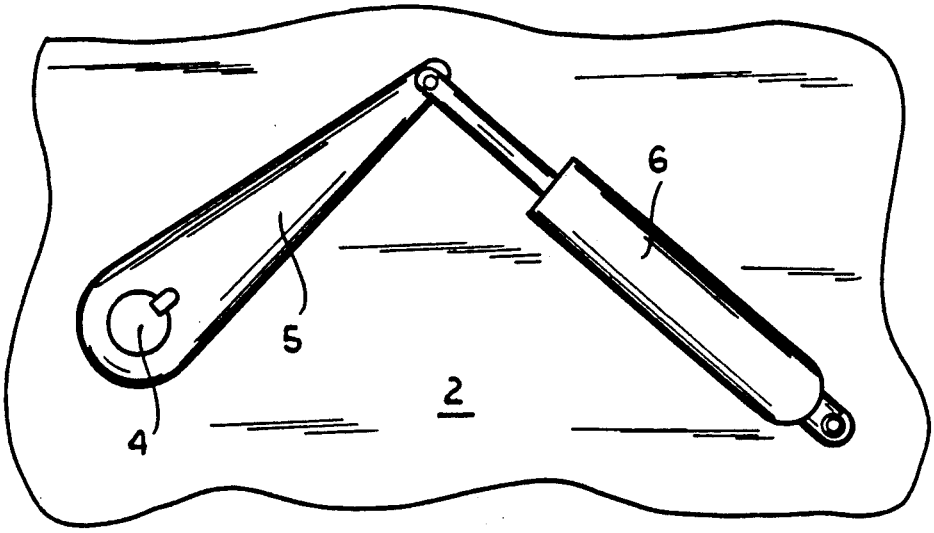
FIG. 3 is a side view showing the lever for tilting the traverse of FIGS. 1 and 2 and the fluid-operated cylinder coupled with that lever.

As can be seen from FIGS. 1 and 3, on one of these trunnions 4, a lever arm 5 is keyed and is pivotally connected to the piston rod of a fluid-operated cylinder 6, which in turn is pivotally connected to the plate 2. This allows a swinging of the traverse 3 about a horizontal axis parallel to the roll axis.

The traverse 3 is formed with guide rails 7. On the guide rails 7, guide bodies 8 of respective support arms or levers 9 can ride. The support arms 9 have chucking cheeks 10 which engage in the core of the roll 11 so as to mount the roll between the arms. At least one of the arms 9 is provided with a drive or brake unit 12 shown only diagrammatically for propelling the roll or braking its rotation to control the rate at which the strip material is delivered by the roll 11.

Figure 2:
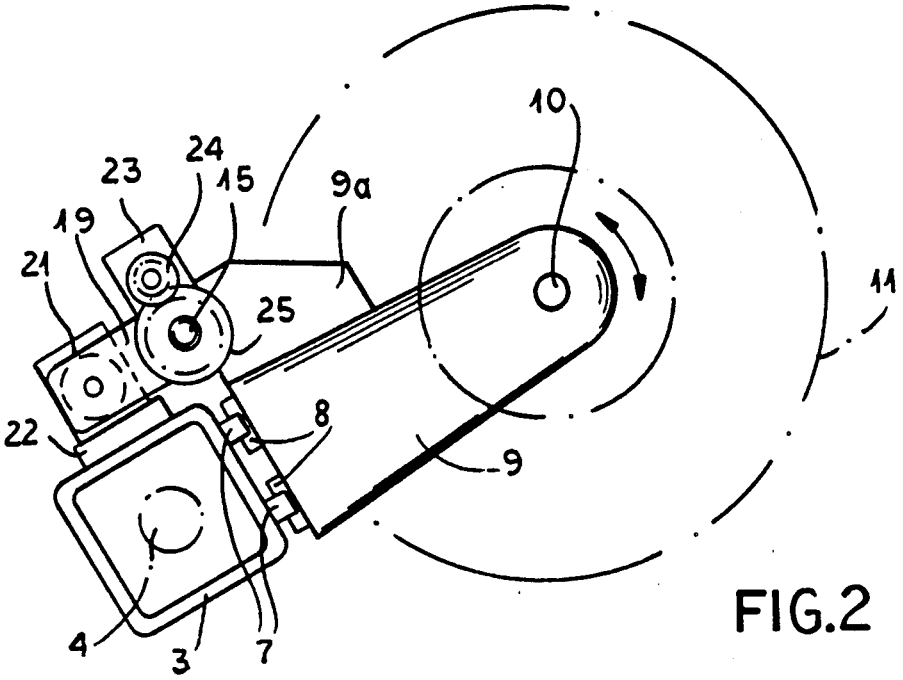
FIG. 2 is a side view thereof with one of the machine frame plates removed.

On or about each support arm 9, a respective spindle nut 13 is fixedly mounted. In the embodiment illustrated in FIGS. 1 and 2, the spindle nut is carried by a plate 9*a* projecting from the respective arm 9.

Each spindle nut 13 is threadedly engaged with a respective threaded segment or end 14, 15 of a spindle shaft 16.

The spindle segments 14 and 15 are of opposite thread hand or sense so that, upon rotation of the shaft 16, the arms 9 will be moved together or apart depending upon the sense of rotation. This allows the reel 11 to be engaged between the cheeks 10 or to be released from the chucks 10.

The shaft 16 is journaled in a journal or bearing sleeve 17 which contains at least one two-sided axial thrust bearing 18 shown only schematically in FIG. 1. The details of the bearing rings, races and roller elements have not been shown here.

The bearing sleeve 17 is engaged between the shanks 19 of a fork formed by these shanks which are each connected with one end of a piston rod 20 of a double-acting positioning cylinder 21. The positioning cylinder 21 is mounted on a block 22 fixedly connected with the traverse 3.

A spindle motor 23 is mounted on the bearing sleeve 17 and has its drive pinion 24 in mesh with a driven gear 25 keyed to the shaft 16.

The reversible motor 23 permits opposite movements of the arms 9 toward one another to engage the roll 11 or away from one another to release the roll. Via the positioning cylinder 21, the bearing sleeve 17 and the shaft 16 can be displaced axially to correspondingly entrain both of the arms or levers 9 in the same direction to reposition the roll 11. The engagement of the roll between the arms 9 is not affected by this axial movement.

The additional movement of the entire unwinding unit formed by the arms 9 and the roll 11 transverse to the direction in which the strip runs enables positioning of the edges of the strip in normal operation and the alignment of the edges of the strip of a new roll with the edges of the trailing end of the strip material previously delivered during a splicing operation.

We claim:

1. An unwinding device for a roll of a strip material, the device comprising:

a support;

a traverse swingably mounted on said support for pivotal movement about a traverse axis and axially nondisplaceable relative to the traverse axis;

a pair of roll-support arms axially slidable on said traverse toward and away from one another and slidable jointly along said traverse in a direction parallel to said axis, said roll-support arms being provided with means for engaging the roll of strip material to be unwound;

a spindle having threaded portions of opposite hand threadedly connected to the respective arms and rotatable in one sense to draw said arms toward one another and in the opposite sense to displace said arms apart;

a journal sleeve receiving and axially coupled to said spindle between the threaded portions thereof and enabling rotation of the spindle about a spindle axis parallel to the traverse axis;

a spindle motor mounted on the sleeve and operatively connected to said spindle for rotating same in said sleeve;

a positioning cylinder axially fixed on said traverse and having an axially displaceable piston rod extending generally in said direction; and a pair of radially extending and axially spaced shanks fixed on the piston rod and axially flanking and connected to said sleeve for displacing said arms jointly parallel to said axis on axial displacement of the piston rod.

2. The unwinding device defined in claim 1 wherein said cylinder is a double-acting cylinder having said piston rod projecting outwardly from opposite ends thereof and operatively connected to said sleeve by said shanks engaging opposite ends of said sleeve.

3. The unwinding device defined in claim 2 wherein said sleeve has a two-sided axial thrust bearing journaling said spindle therein.

* * * * *